US007013499B2

(12) United States Patent
Tash

(10) Patent No.: US 7,013,499 B2
(45) Date of Patent: Mar. 21, 2006

(54) TOILET AND SINK DRAIN PLUNGER

(76) Inventor: George Tash, 5777 Balcolm Canyon, Somis, CA (US) 93021

( * ) Notice: Subject to any disclaimer, the term of this patent is extended or adjusted under 35 U.S.C. 154(b) by 666 days.

(21) Appl. No.: 08/637,894

(22) Filed: Apr. 25, 1996

(65) Prior Publication Data

US 2003/0079278 A1 May 1, 2003

Related U.S. Application Data

(63) Continuation-in-part of application No. 08/432,245, filed on Apr. 27, 1995, now abandoned.

(51) Int. Cl.
*E03D 11/00* (2006.01)

(52) U.S. Cl. ..... 4/255.11

(58) Field of Classification Search ..... 4/255.11, 4/255.01, 255.05, 255.12
See application file for complete search history.

(56) References Cited

U.S. PATENT DOCUMENTS

| | | | | | |
|---|---|---|---|---|---|
| 1,644,436 | A | * | 10/1927 | Locke | 4/255.08 |
| 2,844,826 | A | * | 7/1958 | Cheiten | 4/255.11 |
| 3,021,532 | A | * | 2/1962 | Gross | 4/255.11 |
| 3,336,604 | A | * | 8/1967 | Lacey et al. | 4/255.11 |
| 4,745,641 | A | * | 5/1988 | Tash | 4/255.11 |
| 5,927,492 | A | * | 7/1999 | Moore | 4/255.11 |

FOREIGN PATENT DOCUMENTS

| | | | |
|---|---|---|---|
| FR | 2540943 | * | 8/1984 |

OTHER PUBLICATIONS

English language translation of FR 2,540,943.*

* cited by examiner

*Primary Examiner*—Robert M. Fetsuga
(74) *Attorney, Agent, or Firm*—Lyon & Harr, LLP; Richard T. Lyon

(57) ABSTRACT

The present toilet and sink drain plunger seals either around or in a toilet or sink drain hole despite the hole's size, configuration and location. The plunger includes an elongated upstanding handle connected to the top of a depending, preferably frusto-conical, open bottomed bellows in the sidewalls of which are formed a vertically stacked series of interconnected horizontal pleats. The plunger further includes a series of toilet drain hole seals connected to each other and to the bottom of the bellows to form a unitary whole depending below the bellows. The seals are of progressively smaller size from the uppermost to the lowermost and all feature inwardly and downwardly curved sealing surfaces. The seals are rings or doughnuts molded into the plunger body. The bottommost seal bears a short vertical small diameter annular wall depending therefrom and which acts both as a seal and a seat for the plunger. The entire plunger can be formed in a single plastic molding operation or, if desired, in separate molding operations for the handle and remainer of the plunger. The plunger is efficient, light in weight, inexpensive and durable.

16 Claims, 4 Drawing Sheets

TOILET AND SINK DRAIN PLUNGER

IDENTIFICATION OF RELATED APPLICATION

This application is a continuation-in-part of U.S. patent application Ser. No. 08/432,245, filed on Apr. 27, 1995, and entitled "Improved Toilet Drain Plunger", now abandoned.

BACKGROUND OF THE INVENTION

1. Field of the Invention

The present invention generally relates to water and sewage drain decloggers and more particularly to an improved type of toilet and sink drain plunger.

2. Prior Art

The usual type of plunger used for declogging sinks and toilet drains and the like comprises a vertical wooden or metal handle, to the bottom of which is secured an inverted thick deformable rubber or plastic cup. The cup is initially very difficult to compress down by the handle, requiring considerable force. It then characteristically suddenly gives way, causing a sudden surge of air to pass into the drain over which it is fixed. This frequently results in loosening of the drain pipe connections and water leakage therefrom. Considerable force is then needed to pull the handle up to provide suction force on the drain. The seal between the bottom end of the cup and the area around the sink or toilet drain hole is frequently inadequate and the cup may slip about over the area, reducing the suction afforded by the cup.

Toilets and sinks have various curvatures in the area surrounding the drain hole, making difficult the proper seating of conventional drain plungers, especially toilet drain plungers such as the above-described cup plunger. The most efficient toilet and sink drain plunger available is that shown in U.S. Pat. No. 4,745,641. But even that plunger is unable to seat securely over and hold in place around curtain toilet drain holes, due to the curved configuration of the toilet around the drain hole.

Accordingly, there is a need for an improved type of toilet and sink drain plunger which can seat securely over or in the toilet or sink drain hole, regardless of the curvature of the area around the drain hole. Such plunger should be simple, efficient, capable of being easily fabricated and used and be inexpensive and durable.

SUMMARY OF THE INVENTION

The improved toilet and sink drain plunger of the present invention satisfies all the foregoing needs. The plunger is adapted for use with a wide variety of sizes and shapes of sinks and toilets. Its bottom end can fit into or around the drain hole and provide an improved seal for improved declogging of the drain hole. Moreover, the plunger operates smooth and with little effort. It avoids the sudden air surge through the drain pipe which can loosen it. The improved plunger is substantially as set forth in the ABSTRACT OF THE DISCLOSURE.

Thus, the plunger comprises an upstanding preferably vertical handle, to the lower end of which is permanently or releasably secured a bellows having a plurality of vertically stacked horizontally extending integrally interconnected pleats. The plunger further includes drain hole sealing means in the form of a vertically stakced series of integral drain seals connected to and/or forming part of the lower portion of the bellows. The seals and bellows can be formed in a single molding operation from plastic, rubber or the like. The handle can also be formed in the same molding operation, if desired. Accordingly the entire plunger can be of unitary construction. For such purposes, the portion of the mold which molds the handle can have an entry port which introduces into that portion of the mold a plastic which, when molded, forms a rigid handle integral with the plunger bellows, while the bellows portion of the mold can have a separate entry port which introduces into the mold a plastic which is flexible when molded but which integrally joins to the handle.

The seals are of progressively smaller diameter from top to bottom of the series and are of bulbous ring configurations, except that the bottommost seal has a depending portion which has a short vertical cylindrical configuration. The seals effect their sealing on their external surface which are on the outer surface of the plunger. The seals and bellows have controlled flexibility and resiliency for pre-selected deformability to improve their sealing and pumping efficiency.

Various other features of the improved toilet and sink drain plunger of the present invention are set forth in the following detailed description and accompanying drawings.

DRAWINGS

DETAILED DESCRIPTION

Figure 1:
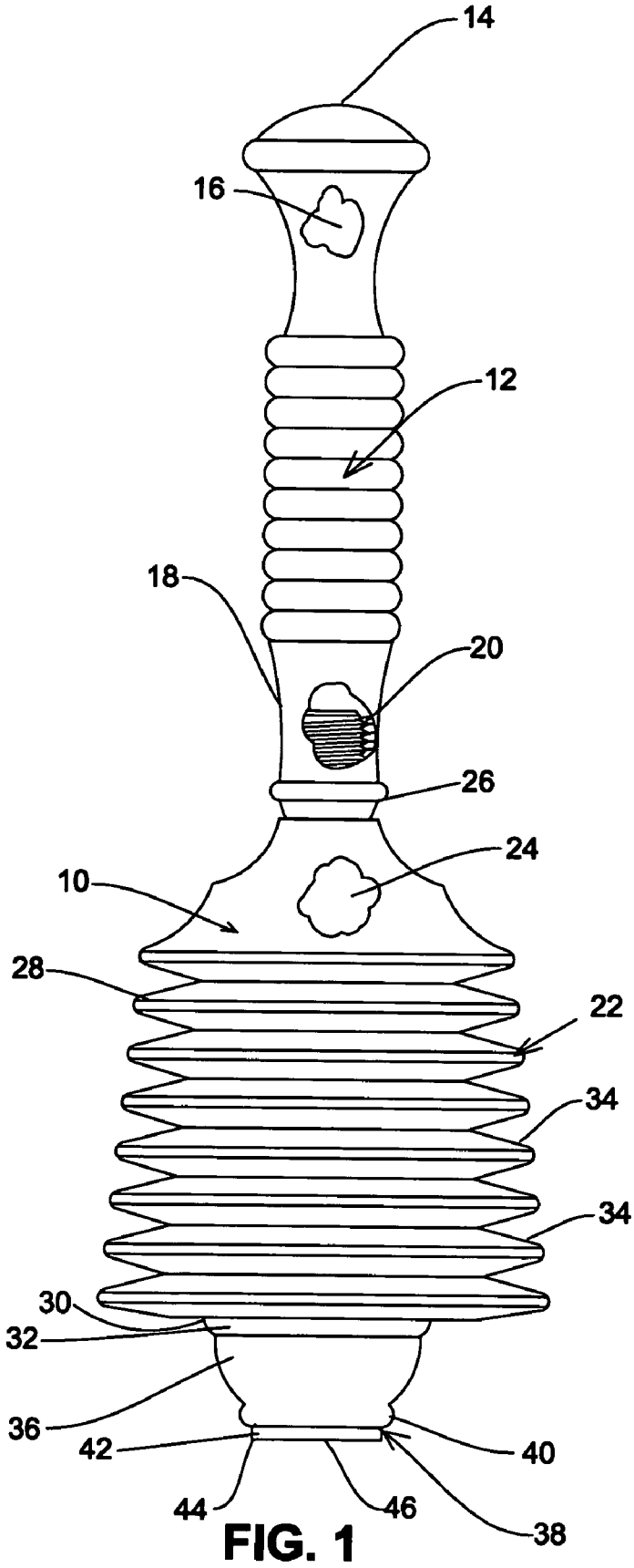
FIG. 1 is a schematic side elevation, partly broken away, of a preferred embodiment of the improved toilet and sink drain plunger of the present invention, showing the plunger in a standing resting condition.

FIGS. 1–3:

Now referring more particularly to FIGS. 1–4 of the drawings, a preferred embodiment of the improved toilet and sink drain plunger of the present invention is schematically depicted therein. Thus, plunger 10 is shown, which comprises an elongated vertical handle 12, the upper end of which is formed into an expanded knob 14 adapted to comfortably rest in the palm of the hand of the plunger user. Preferably, handle 12 is hollow, having a central space 16 therein to reduce its weight, and can, if desired, be formed of moldable, rigid, light weight plastic such as high density polyethylene plastic or the like.

The bottom portion 18 of handle 12 may include external integral threads 20 so that handle 12 can be releasably connected to the bellows 22 of plunger 10. Alternately the entire plunger 10 can be of unitary construction.

Bellows 22 is generally frusto-conical in shape, has a central space 24 extending therethrough defined by a closed transversely extending top 26 which preferably threadably receives the bottom portion 18 of handle 12, sidewalls 28 integral with top 26 and depending therefrom, and a bottom portion 30 integrally connected to top seal 32.

Figure 2:
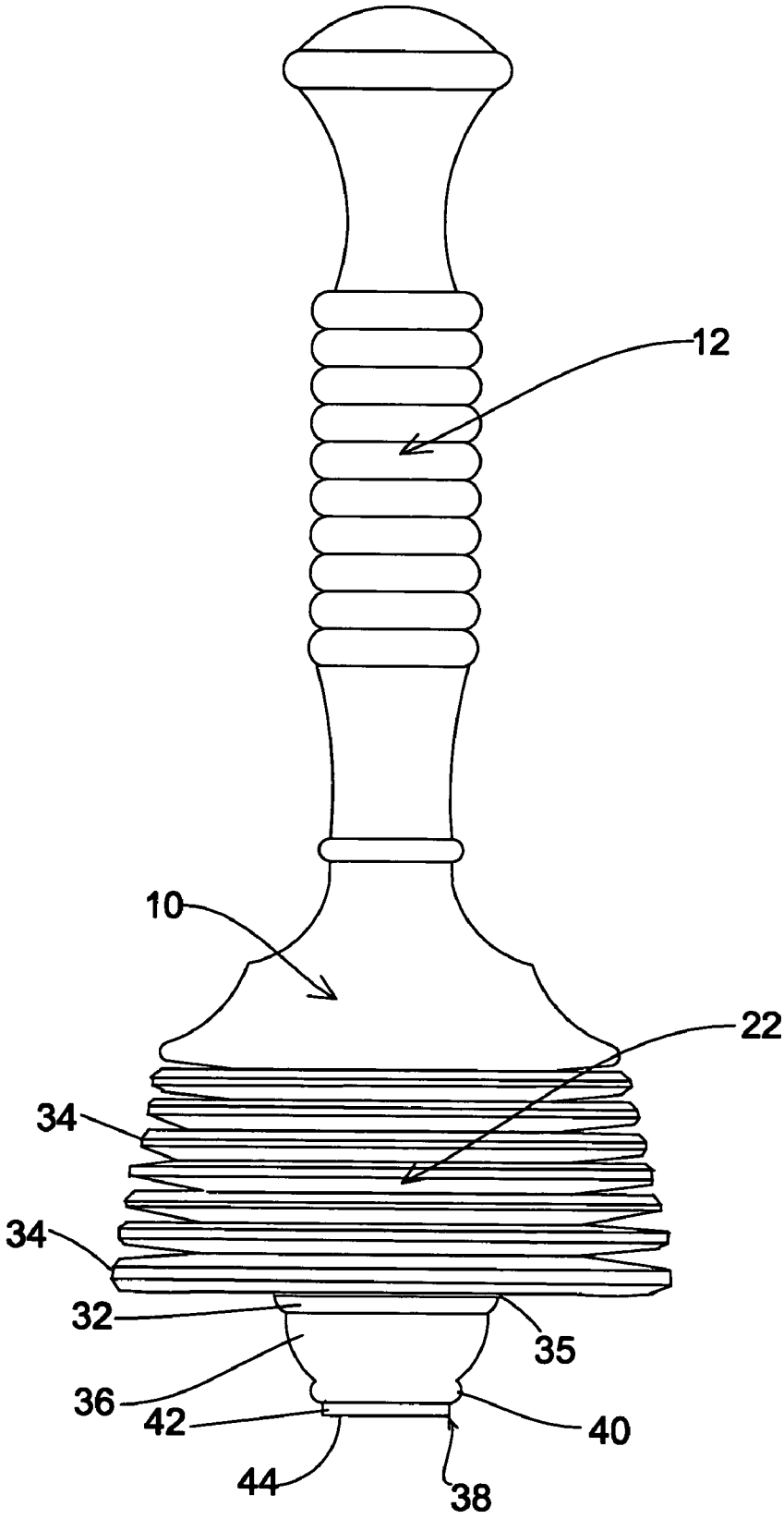
FIG. 2 is a schematic side elevation of the plunger of FIG. 1, shown with the bellows of the plunger fully collapsed, that is, compressed, such as occurs for the downward stroke when the plunger is being used for declogging a toilet or sink drain.
Figure 3:
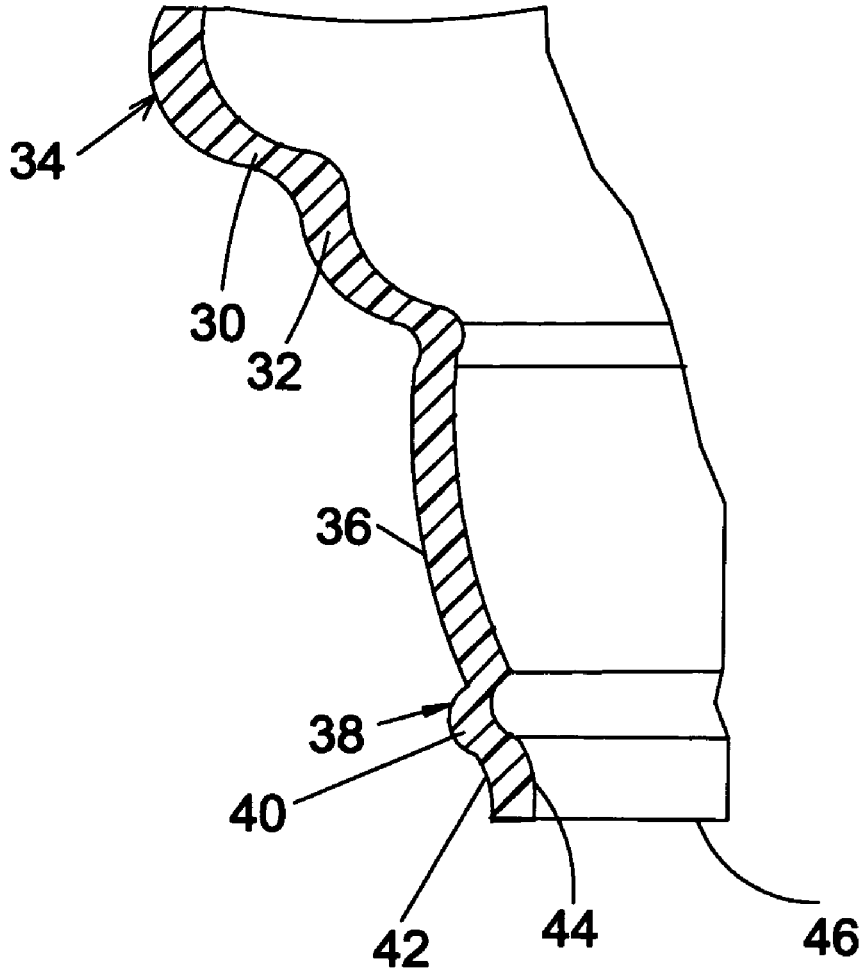
FIG. 3 is an enlarged schematic fragmentary cross-section of the sealing portion of the plunger, illustrating the curvatures of the seals.

Sidewalls 28 are formed into a plurality of integral horizontally extending vertically stacked interconnected pleats 34. Pleats 34 are of progressively larger diameter and preferably progressively greater flexibility from the uppermost to the lowermost of said pleats 34, so that pleats 34 easily and smoothly compress during use of plunger 10 and efficiently nest together, as shown in FIG. 2 when bellows 22 is collapsed by pushing down on handle 12, avoiding the sudden air surging characteristic of conventional toilet drain plungers. If desired, the wall thickness of the pleats 34 can vary, for example, decreasing from the uppermost pleats 34 to the lowermost pleats 34 to control their flexibility.

Bellows 22 is formed of plastic or rubber, with the pleats 34 being flexible and resilient and exhibiting elastic memory. Bellows 22 can be formed in a single molding operation from, for example, low density polyethylene plastic mixed with, for example, varying proportions of copolymer of ethylene and vinyl acetate as the means to control the relative flexibility and resiliency of the various portions of bellows 22. Thus, top 26 is relatively less flexible while pleats 34 are relatively more flexible. During the molding operation a mixture of the plastics which will form the less flexible top 26 can be introduced into the mold and then a plastic mixture which results in the more flexible pleats 34 can be introduced into the mold, so that in the single molding operation the bellows that molded will exhibit the required differences in flexibility between top 26 and pleats 34. This is a known molding procedure.

Seal 32 is ring-shaped and relatively less flexible than plate 34 due to its size and shape and/or wall thickness and also, if required, due to a change in the composition of the plastic mixture from that of the pleats 34. Seal 32 has an annular wall 35 which curves downwardly and inwardly from its point of connection with the underside of the lowermost of pleats 34 to its point of connection with the upper end of the second seal 36 of plunger 10.

Seal 36 is also ring-shaped but relatively more bulbous and is longer than seal 32, curving continuously downwardly to its narrowest diameter at its point of connection with the lowermost third seal 38.

Seal 38 is relatively short in height and also ring-shaped in its upper portion 40, from the bottom of which vertically depends its lower portion 42, which is in the form of a short thin vertical cylindrical wall 44 with a horizontal bottom end 46 which enables plunger 10 to rest in the upright position of FIG. 1. Portion 40 has a diameter slightly greater than that of the lower end of seal 36, while portion 40 is of smaller diameter than portion 32. Seals 36 and 38 are similar in flexibility and construction to seal 32, that is, less flexible than bellows 22.

Seal 32 is of greater diameter than seal 36, while the maximum diameter of seal 36 is greater than that of seal 38. Seals 32, 36 and 38 provide their sealing effect on their external surfaces which are on the outer surface of plunger 10. With this arrangement, plunger 10 can be used to efficiently seal sink and toilet drain holes of various sizes and shapes. Seals 32, 36 and 38 can be formed in a single molding operation. Moreover, space 24 extends down through the interior of seals 32, 36 and 38. Seals 32, 36 and 38 can be formed of the same materials as bellows but of different relative proportions of those materials than for bellows 22 so as to control their flexibility. Moreover, their size, shape and wall thickness contribute to their degress of flexibility.

Figure 4:
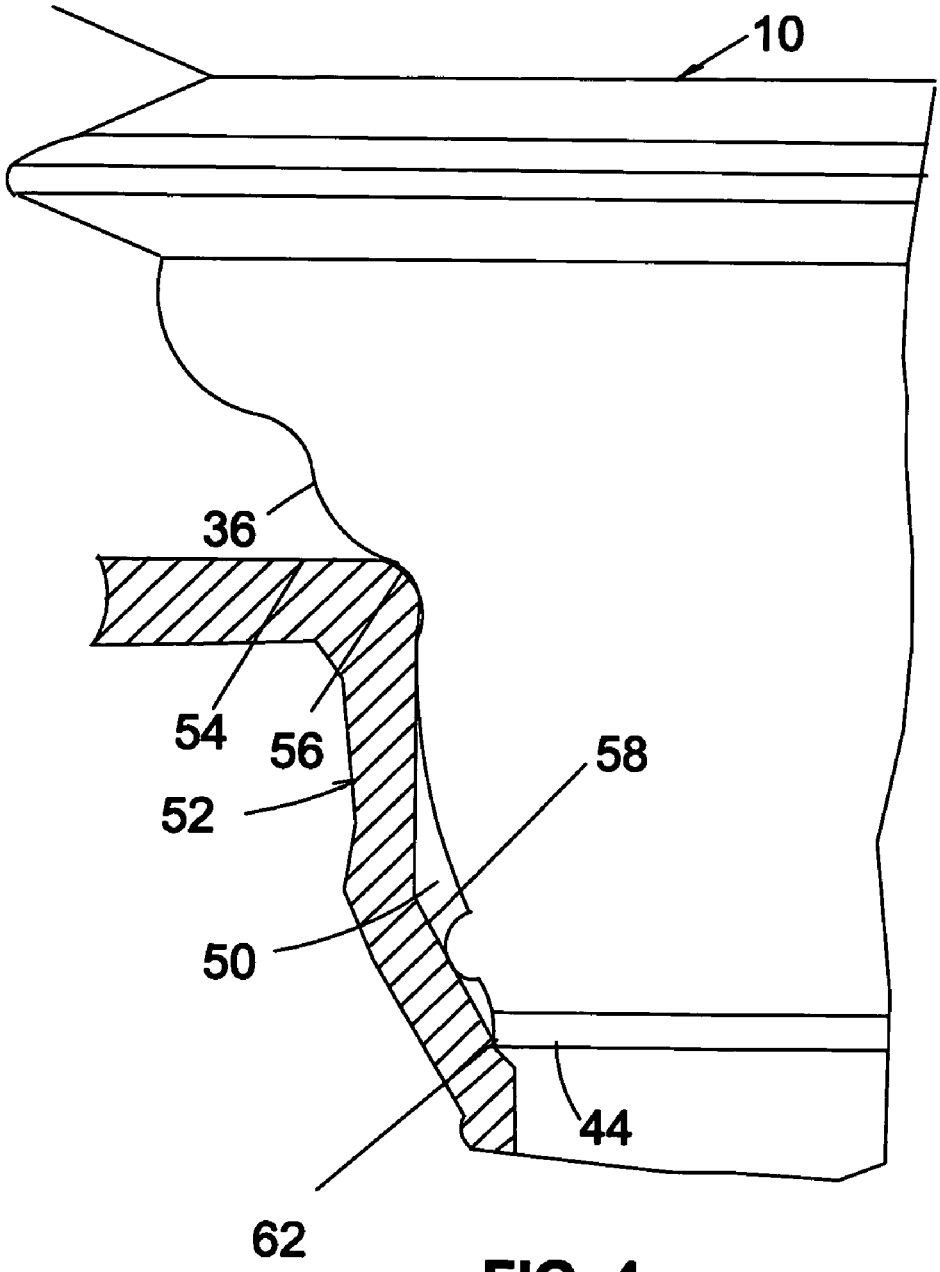
FIG. 4 is an enlarged, fragmentary, schematic side elevation, partly in cross-section, of the improved drain plunger of FIGS. 1–3, showing the plunger rings in sealing contact with the opening in a kitchen sink.

Wall 44 can be placed around a drain hole or within it. The edges of the drain hole can abut the underside of portion 40, seal 36 or seal 32, depending on the size of the drain hole. Seals 32, 36 and 38 are sufficiently deformable to increase their sealing effect as they are pressed against the drain hole edges during use of plunger 10. In FIG. 4, it is seen that when plunger 10 is inserted into a drain hole in this instance, a stepped kitchen sink drain hole 50 defined by sink 52, bulbous curved seal 36 is deformed inwardly by sink ledge 54 at point 56 forming a tight seal therewith, while depending vertical wall 44 strikes ledge 58 at a lower point 62, again acting as a seal. The effective sealing thus provided by plunger 10 in kitchen sink drain hole 50 enables plunger 10 to function very smoothly and efficiently to unclog drain hole 50. Plunger 10 can fit into a many different toilet bowl openings. Hence, a variety of different toilet bowls can be effectively sealed and unclogged by this plunger 10.

Accordingly, plunger 10 is adapted for efficient use with a variety of sizes and shapes of sink and toilet bowls and drain holes. Plunger 10 can be used in the mode of being disposed around the perimeter of the drain hole. But in most cases, plunger 10 is used by inserting its lower end into the drain hole, with the appropriate sized seal 32, 36 or 38 and in some instances wall 44 abutting the edges of the drain hole to efficiently seal it. Plunger 10 avoids the difficulties inherent in trying to fit a plunger cup around the curved surfaces defining the entrance to a toilet or sink drain hole.

Further advantages of the improved toilet and sink drain plunger of the present invention are as set forth in the foregoing. Various modifications, changes, alterations and additions can be made in the improved plunger of the present invention, its components and parameters. All such modifications, changes, alterations and additions as are within the scope of the appended claims form part of the present invention.

What is claimed is:

1. A toilet and sink drain plunger comprising, in combination:

a) a handle;

b) a bellows which includes a plurality of horizontally extending pleats; and, c) three toilet and sink drain hole seals disposed on the outside of said plunger in horizontally extending vertically stacked relation, said three seals being ring-shaped and of progressively smaller diameter from the uppermost to the lowermost of said three seals, each said seals having a sealing surface.

2. The toilet and sink drain plunger of claim 1 wherein said handle is vertical and at the upper end of said plunger, wherein said bellows is secured to the bottom of said handle and depends therefrom and wherein said seals are integral with the lower end of said bellows.

3. The toilet and sink drain plunger of claim 2 wherein said handle, bellows and seals are of plastic.

4. The plunger of claim 2 wherein one or more of the three seals is slightly larger than an opening of a standard sink or drain.

5. The plunger of claim 4 where one or more of the three seals is sufficiently flexible to deform inwardly when inserted into a standard sink or drain opening in order to form an interference fit, thus producing a mechanical seal with a wall defining the drain opening.

6. The plunger of claim 2 wherein the bellows section is formed of flexible resilient plastic.

7. The plunger of claim 2 wherein said handle is releasably connected to said bellows.

8. The plunger of claim 2 wherein said handle is of unitary construction with said bellows.

9. A toilet and sink drain plunger comprising:

a) a handle;

b) a bellows secured to said handle; and, c) toilet and sink drain hole sealing rings integral with the lower end of said bellows, said sealing rings comprising, i. an upper annular curved first ring depending from the lowermost portion of said bellows cooperating therewith to form on the outer surface a first drain hole seal;

ii. a bulbous annular curved second ring depending from said first ring, located relative to said first ring to form on its outer surface a second seal smaller than said first seal; and, iii. a third bottom ring secured to the underside of said second seal, smaller in diameter than said second seal, the outer surface of said bottom ring forming a third seal, said seals being integral with each other and said bellows and having a central opening therein communicating with said bellows space.

10. The toilet and sink drain plunger of claim 9 wherein said plunger bellows and seals are of unitary construction, having been integrally joined together in a single molding operation.

11. The toilet and sink drain plunger of claim 10 wherein said bellows and seals are of flexible resilent plastic.

12. The toilet and sink drain plunger of claim 11 wherein said handle is detachable from said bellows and also of plastic.

13. The toilet and sink drain plunger of claim 9 wherein said bottom seal includes an upper bulbous annular ring portion and a lower portion having a short vertical sidewall of smaller diameter than said upper portion.

14. The toilet and sink plunger of claim 13 wherein each said ring includes an inwardly and downwardly curved lower party adapted to sealingly engage a toilet or sink drain hole and wherein said ring is of substantially greater heighth than said first and third rings and of a continuously curved bulbous shape with its lower end of less diameter than its upper end.

15. The toilet and sink drain plunger of claim 14 wherein the lower end of said plunger is horizontal to enable said plunger to rest in an upright position.

16. The toilet and sink drain plunger of claim 9 wherein said bellows includes sidewalls comprsing a plurality of integral, vertically stacked, interconnected, horizontally extending pleats capable of nesting during compression of said bellows to a collapsed state, and wherein said pleats are more flexible than said seals.

* * * * *